United States Patent [19]

Reiss et al.

[11] Patent Number: 4,471,211

[45] Date of Patent: Sep. 11, 1984

[54] LIQUID TO GAS FUEL HEATING DEVICE

[76] Inventors: Mitchell Reiss, 3 Farmview Dr., Dix Hills, N.Y. 11746; Vincent Guarnaschelli, 31 Alton Ave., Greenlong, N.Y. 11740

[21] Appl. No.: 539,093

[22] Filed: Oct. 5, 1983

[51] Int. Cl.[3] ..... F22B 1/28

[52] U.S. Cl. ..... 219/274; 219/271; 431/208

[58] Field of Search ..... 431/207, 208, 210; 219/271, 552, 272, 273, 274; 48/103

[56] References Cited

U.S. PATENT DOCUMENTS 1,688,796 10/1928 Baker ..... 219/275

4,193,755 3/1980 Guarnaschelli et al. ..... 431/208

*Primary Examiner*—Carroll B. Dority, Jr.

*Attorney, Agent, or Firm*—Richard L. Miller

[57] ABSTRACT

A heating device for use in a fuel burning apparatus for converting liquid fuel into a vapor. The heating device includes a heating element disposed within a cylindrical housing and having an absorbing material disposed is a spiral recessed path around the heating device's cylindrical housing. A receiving tube is coupled to the absorbing material for receiving the liquid fuel and directing it onto the spiral path. The cylindrical housing surrounds the heating element.

7 Claims, 5 Drawing Figures

LIQUID TO GAS FUEL HEATING DEVICE

BACKGROUND OF THE INVENTION

This application is related to application Ser. No. 090,756 which is a continuation-in-part application of U.S. Pat. No. 4,193,755 issued May 18, 1980. This application contains similar but not the identical subject matter of its predecessors.

BACKGROUND OF THE INVENTION

This invention relates to a fuel burning devices, and more particularly to a device which efficiently converts liquid fuel into a vapor for subsequent use in a fuel burning apparatus.

One of the most difficult problems with liquid fuel burning equipment concerns obtaining the greatest amount of efficiency from the utilized of fuel. Most conventional liquid fuel burning devices take the liquid fuel and atomize it into small drops by means of pressure. The atomized liquid fuel is then mixed with air to form a fuel-air mixture and is sent to a burner where the heat and flame is produced. Attempts are made to heat the mixture in order to obtain a vapor at the time that it is in the furnace so that the actual mixture is vaporized as much as possible. However, because the fuel proceeds to the furnace as liquid droplets mixed with air, there is a great amount of fuel waste since the liquid particles continue to remain in the furnace and low efficiency results. Because a great amount of fuel remains as liquid particles and is not vaporized, in addition to poor efficiency, conventional burners produce a tremendous amount of pollutants. Much of the liquid fuel particles are converted into soot and other waste products which pollute the atmosphere as well as providing dirt in the environment around the fuel burning equipment. The lack of complete burning also produces smoke and odors in the environment.

In our U.S. Pat. No. 4,193,755 there has been provided a fuel burning apparatus which includes a heating device fore receiving a liquid fuel and converting it almost entirely into a vapor. The vapor is then mixed with air to provide a combustible mixture which is then conveyed to a burner where the combustible mixture is burned. The heating device includes at least one heating element having a spiral path directly around the outside thereof. A receiver is connected to the heating element in order to receive all of the liquid fuel and direct it onto the spiral path. In this manner, the liquid fuel flows directly around the heating element until it is almost entirely converted into a vapor.

The heating elements are positioned in a mixing tank having an air inlet and an outlet. Air under low pressure is sent into the mixing tank and flows across the entire heating element in order to mix with the vaporous fuel. The mixture then leaves through the outlet and proceeds to the burner.

When the fuel first arrives at the upper end of the spiral, it is in a liquid state. It remains within the spiral absorbing means and proceeds, directly around the heating element where the bonds holding together the molecular structure of the fuel as a liquid are separated in order to produce a very fine vapor. However, the fuel is not broken down into its constituent products, rather, it does remain as a fuel. As the fuel proceeds to be vaporized as it moves downward, directly along the heating element, the air flowing across the heating element picks up the vapors and will produce the combustible mixture of the air and the vaporized fuel.

The aforedescribed heating device actually produces greatly improved results. The efficiency of the burner utilizing this type of heating device is extremely more efficient than conventional burners. Additionally, it has been found that there is little, if any, environment contamination in the area around the burner. Little soot is produces, little waste of fuel is produces, and there are little, if any particles, which can escape to produce any waste products.

However, while more efficient and clean fuel burning apparatus is produces, it has been found that insufficient volume of fuel is achieved per heating device. One of the reasons for the reduced amount of volume is that the air passes across the entire heating element. As it passes, the air tends to rapidly cool off the heating element whereby it lowers the temperature of the heating element and prevents the heating elements from providing vaporization of all of the fuel directly flowing spirally around the element. Additionally, since the air passes across the entire element, even its upper portions, the fuel along the upper portion of the heating element may not have has a sufficient opportunity to become vaporizes and nevertheless may be drawn off from the heating element by the passing flow of air. An additional situation is that the fuel initially reaching the heating element may spatter a little which may cause some of the fuel particles to jump away from the spiral absorbing wire and may get caught into the path of the flowing air even before it is vaporized.

Additionally, in order to obliviate the disadvantages of the invention we have conducted further experimentation and come up with the apparatus disclosed in our patent application Ser. No. 090,756.

The improved heating device contained a heating element with an absorbing material formed in a spiral path directly around the heating element. A receiving means is coupled to the heating element for receiving the liquid fuel and directing it onto the spiral path. A sheild surrounds at least a substantial part of the heating element with only a lowermost portion of the heating element being exposed to the air. Unfortunately, this configuration exhibited a periodic flashback which in itself was pollutive. Obviously further experimentation was again needed to obliviate these newly confronted drawbacks so as to produce a trouble free fuel vaporizing heating device.

SUMMARY OF THE INVENTION

Accordingly, it is an object of the present invention to provide a heating device which improves over the aforementioned problems.

Another object of the present invention is to provide a fuel vaporizing device which can be used in a fuel burning apparatus of the type described in our U.S. Pat. No. 4,193,755.

Still another object of the present invention is to provide a fuel vaporizing heating device especially designed for converting liquid fuel into its vapor for subsequent mixing of air to provide a mixture for a fuel burner.

Another object of the present invention is to provide a fuel vaporizing heating device especially designed for converting liquid fuel into its vapor for subsequent mixing of air to provide a mixture for a fuel burner.

Another object of the present invention is to provide a fuel vaporizing heating device which is more efficient, substantially odorless, substantially without any soot or flashback and more effective than conventional fuel burning apparatus and yet provides sufficient volume of fuel for use in a fuel burner.

Briefly, the invention comprises a heating device for use in a fuel burning apparatus for converting liquid fuel into a vapor. The heating device includes a heating element disposed within a cylindrical housing and having an absorbing material disposed in a spiral recessed path around the heating device's cylindrical housing a receiving means is coupled to the absorbing material for receiving the liquid fuel and directing it onto the spiral path. The cylindrical housing surrounds the heating element.

The receiving means is a hollow tube connected directly to the extended end of the absorbing material which is spirally wrapped around and within a recess formed on the periphery of the cylindrical housing.

The aforementioned objects, features and advantages of the invention will, in part, be pointed out with particularity and will, in part, become obvious from the following more detailed description of the invention taken in conjunction with the accompanying drawings, which form an integral part thereof.

BRIEF DESCRIPTION OF THE DRAWINGS

In the various figures of the drawings, like references characters designate like parts.

DESCRIPTION OF THE PREFERRED EMBODIMENT

Figure 1:
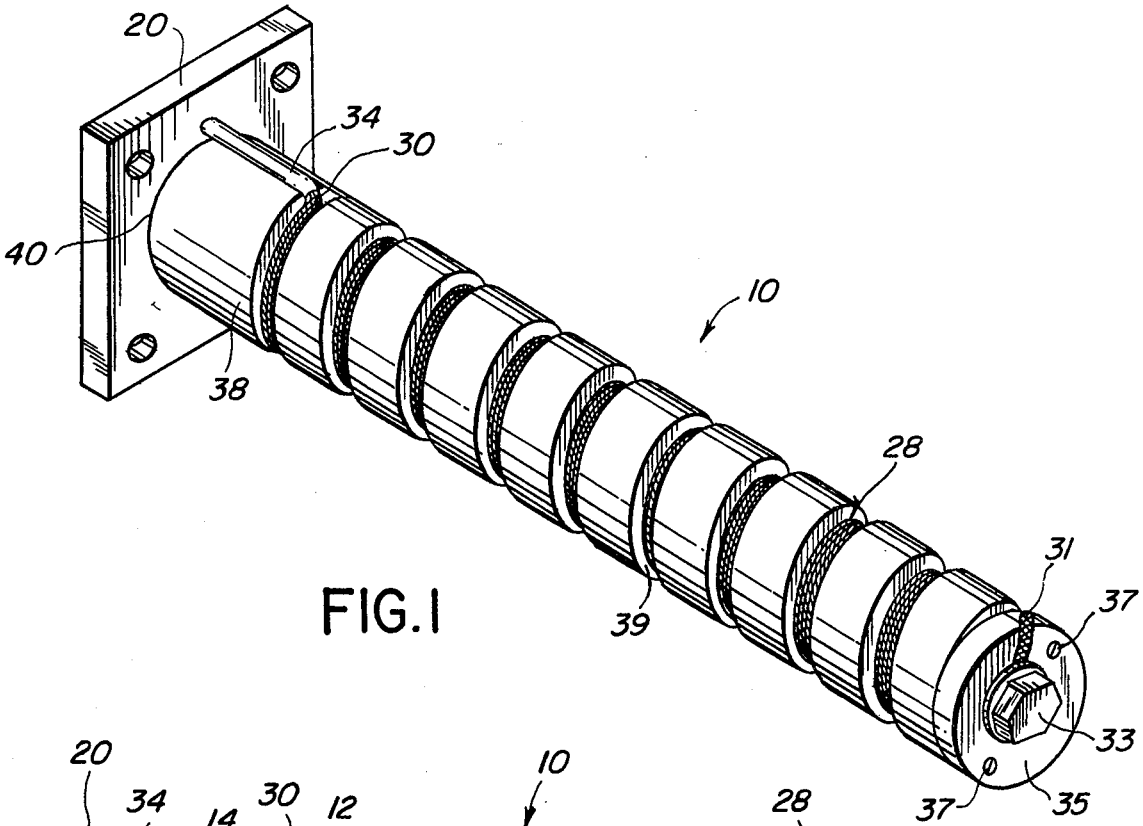
FIG. 1 is a perspective view of the invention.
Figure 2:
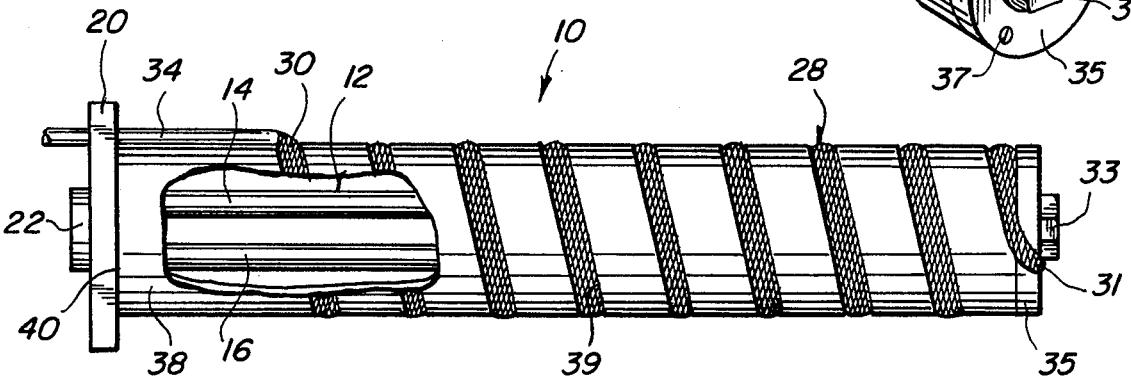
FIG. 2 is a side elevational view with parts broken away to show the internal construction of the invention.
Figure 3:
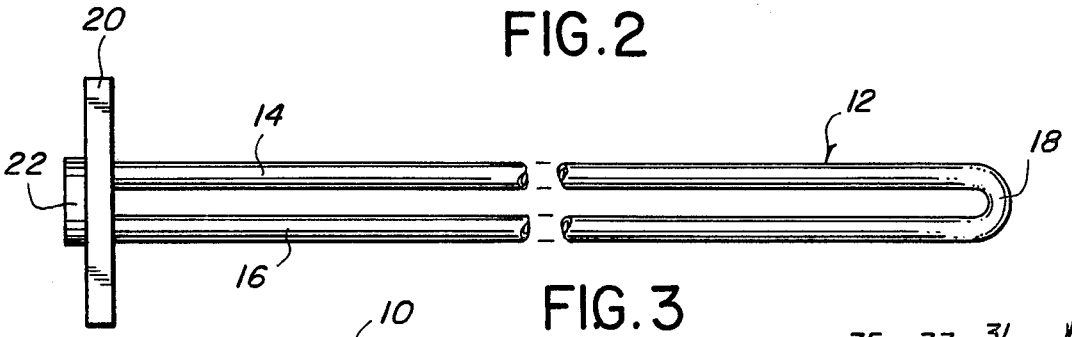
FIG. 3 is a side elevational view of the actual internal heating element.
Figure 5:
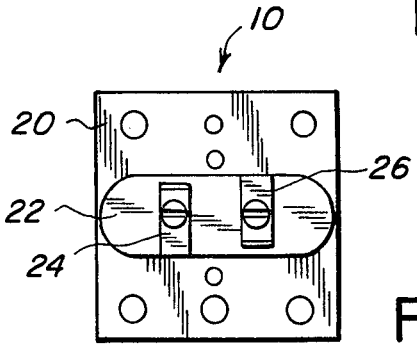
FIGS. 4, and 5 are opposite end view of the invention.
Figure 4:
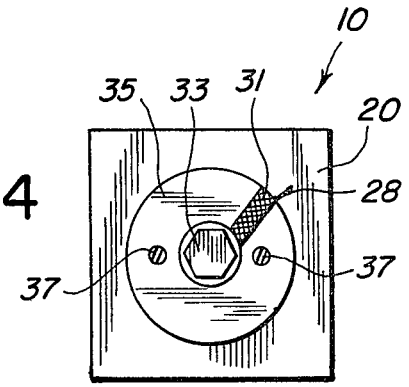

Referring now to the figures, the improves fuel vaporizing device is shown generally at 10 and includes a U-shaped electrical heating element 12 having legs 14, 16 interconnected by a bight portion 18. The upper ends of the legs extend upwardly through a support head 20 and connect to the terminal block 22 on which are placed electrical terminal connections 24 and 26. The electrical terminal 24 is electrically interconnected to the leg 14 and the terminal 26 would be interconnected to the leg 16. One such typical heating element is available under the trademark name CALROD®, produced by the General Electric Company. Around the outside of the U-shaped heating element is disposed a hollow cylindrical housing 38. The spiral path 39 is formed on the periphery of the hollow cylindrical housing 38 to receive the absorbing material wire 28. For example, absorbing material wire 28 can be formed of stranded wicker wire, such as picture frame wire or other such similar material.

A single length of absorbing wire 28 is would around hollow cylindrical housing 38. The upper end 30 of the absorbing material wire 28 extends upwardly through hollow tube 34. Hollow tube 34 extends from a point beneath the header 20 to a point extending upwardly through and above the header 20. The other end 31 of the absorbing material wire 28 is attached by bolt 33 to the bottom cap 35 of hollow cylindrical housing 38. Cap 35 is held in place by means of screws 37.

In operation, the upper end 30 of the absorbing material wire 28 would be connected to a portion of the fuel supply via hollow tube 34. It could be connected directly to a fuel tank (not illustrated) or it could be connected to a capillary distribution system extending from valves which adjust the amount of fuel following to the absorbing material wire 28. The amount of fuel entering the absorbing material wire 28 is typically adjusted at approximately a drop rate so that the fuel flows through the absorbing material wire 28. The tube 34 is provided so that the fuel can be suitably collected within the absorbing material wire 28 which passes through the spiral path 39 which is disposed around the hollow cylindrical housing 38. The fuel then passes around the hollow cylindrical housing 38 in a spiral fashion within the spiral path 39 provided by the absorbing material wire 28. The heating device 10 is connected to a source of electrical supply (not illustrated) so as to heat up the heating element 12. As the fuel passes downwardly along the spiral path 39 of the absorbing material wire 28 of the hollow cylindrical housing 38, the fuel will vaporize.

As described in our U.S. Pat. No. 4,193,755 this, as well as other similar heating devices 10, would be placed within a mixing tank and air would be sent into the mixing tank at a low pressure. The air would pass across the surfaces of the heating devices 10 and would remove the vaporized fuel into the air providing a suitable combustion mixture of fuel vapor and air.

However, in contradistinction, when the heating element 12 is exposed, the passing air may tend to cool the heating element 12 so that the rapid cooling of the heating element 12 prevents sufficient heat from vaporizing the fuel. As a result, these may be insufficient volume of fuel provided when relying simply on a drop rate and with the air directly crossing the heating element 12. Therefore, the heating element 12 is placed within the hollow cylindrical housing 38 to obliterate this problem. The presence of the hollow cylindrical housing 38 avoids excessive cooling of the heating element.

The upper end 40 of the hollow cylindrical housing 38 is connected to the underneath of the header 20. By affixing the upper end 30 of the absorbing material wire 28 into hollow tube 34, the fuel rate can actually be increased above the drop rate so that a greater volume of fuel can pass along. This will obviously increase the volume of the fuel to be burned. It will therefore be appreciated that by utilizing the present invention, a greater amount of fuel can be sent to the heating device 10 so that a greater volume of fuel will be provided in a mixture and as a result, a reduced number of heating devices 10 can be utilized in a mixing chamber.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A heating device for use in fuel burning apparatus for converting liquid fuel into a vapor, comprising:

(a) a hollow cylindrical housing;

(b) heating element means disposed within said hollow cylindrical housing;

(c) an absorbing material formed in a recessed spiral path around said hollow cylindrical housing; and (d) receiving means coupled to said absorbing material for receiving the liquid fuel and directing it onto said spiral path.

2. The heating element as in claim 1, wherein said heating elements means is a "U"-shaped electrical heating element having the ends of its legs capable of connection to an electrical power supply.

3. The heating device as in claim 2, wherein said absorbing material is stranded wire wrapped within a recess around said hollow cylindrical housing.

4. The heating device as in claim 3, wherein said hollow cylindrical housing is longer than said "U"-shaped heating element, said hollow cylindrical housing containing a header disposed at its upper end and a cap disposed at its lower end.

5. The heating device as in claim 3, wherein said receiving means is a hollow tube disposed adjacent to said upper end of said hollow cylindrical housing, the upper end of said stranded wire being insertable into said hollow tube.

6. The heating device as in claim 3, wherein the upper end of said stranded wire respectively extends for connection to a supply of fuel.

7. The heating device as in claim 1, further comprising a header support from which depends said heating element means, electrical terminals formed onto said header and electrically connected to said heating element means, and fastening means coupling said hollow housing to said header.

* * * * *